US009580919B2

(12) United States Patent
Keersmaekers

(10) Patent No.: US 9,580,919 B2
(45) Date of Patent: Feb. 28, 2017

(54) SCAFFOLD WITH SCAFFOLDING ELEMENTS AND METHODS FOR ERECTION THEREOF

(76) Inventor: Marc Keersmaekers, Dessel (BE)

( * ) Notice: Subject to any disclaimer, the term of this patent is extended or adjusted under 35 U.S.C. 154(b) by 94 days.

(21) Appl. No.: 13/810,440

(22) PCT Filed: Mar. 17, 2011

(86) PCT No.: PCT/BE2011/000012

§ 371 (c)(1),
(2), (4) Date: Feb. 19, 2013

(87) PCT Pub. No.: WO2012/006689

PCT Pub. Date: Jan. 19, 2012

(65) Prior Publication Data

US 2013/0206506 A1 Aug. 15, 2013

(30) Foreign Application Priority Data

Jul. 16, 2010 (BE) ..... 2010/0442
Jul. 16, 2010 (BE) ..... 2010/0443

(51) Int. Cl.
*E04G 1/14* (2006.01)
*E04G 1/15* (2006.01)
(Continued)

(52) U.S. Cl.
CPC ..... *E04G 1/15* (2013.01); *E04G 5/00* (2013.01); *E04G 5/147* (2013.01); *Y10T 29/49826* (2015.01)

(58) Field of Classification Search
CPC ..... E04G 21/3295; E04G 2001/242; E04G 7/301; E04G 7/306; E04G 7/307; E04G 1/15; E04G 1/17; E04G 5/00; E04G 5/147; E04G 1/20; E04G 3/28; E04G 2003/283; A63G 7/00; E01B 11/02; E01B 11/20; E01B 11/22; E01B 11/26; E01B 25/04; A63H 18/02; B61B 13/02; B61B 5/00; B61B 5/02
USPC ..... 182/36, 38, 129, 12, 39, 62.5, 112, 113, 182/131, 151, 222, 223; 104/126, 125, 104/124, 53; 414/277–279, 281, 282, 284
See application file for complete search history.

(56) References Cited

U.S. PATENT DOCUMENTS 382,407 A * 5/1888 Boyer ..... 104/124
609,164 A * 8/1898 Prescott ..... 104/55
(Continued)

FOREIGN PATENT DOCUMENTS

| | | |
|---|---|---|
| FI | 89401 | 6/1993 |
| JP | 2002167969 | 6/2002 |
| WO | WO 03025311 | 3/2003 |

OTHER PUBLICATIONS

Definition of 'Scaffold' Found in Action http://dictionary.reference.com/browse/scaffold.*

*Primary Examiner* — Daniel Cahn
(74) *Attorney, Agent, or Firm* — Marcus C. Dawes; Daniel L. Dawes

(57) ABSTRACT

A scaffold comprising at least two horizontally adjacent scaffold sections, the scaffold sections being defined substantially by lengthwise ledgers, transverse ledgers and uprights, characterized in that the scaffold comprises a guide adapted to be able to displace in substantially horizontal direction therealong a displaceable platform corresponding thereto and guided thereby; a method for erecting the scaffold, and a mobile platform.

4 Claims, 13 Drawing Sheets

(51) Int. Cl.
*E04G 5/00* (2006.01)
*E04G 5/14* (2006.01)

(56) References Cited

U.S. PATENT DOCUMENTS

| | | | | | |
|---|---|---|---|---|---|
| 699,960 | A * | 5/1902 | Lachase | 104/63 |
| 799,908 | A * | 9/1905 | Humphrey | 104/121 |
| 1,145,438 | A * | 7/1915 | Potter | 104/126 |
| 1,393,932 | A * | 10/1921 | Andre | 182/129 |
| 1,674,734 | A * | 6/1928 | Maynes | 104/126 |
| 2,249,941 | A * | 7/1941 | Burton | 104/125 |
| 2,695,818 | A * | 11/1954 | Rives | 182/13 |
| 2,912,121 | A * | 11/1959 | Moyer | 212/224 |
| 3,052,191 | A * | 9/1962 | Furlong | 104/135 |
| 3,540,380 | A * | 11/1970 | Tumpak et al. | 104/246 |
| 3,889,605 | A * | 6/1975 | Bacon | 104/56 |
| 4,034,678 | A * | 7/1977 | Wilson | 446/446 |
| 4,170,943 | A * | 10/1979 | Achrekar | 104/56 |
| 4,335,658 | A * | 6/1982 | VanderKelen | 104/69 |
| 4,489,659 | A * | 12/1984 | Kamohara et al. | 104/124 |
| 4,665,829 | A * | 5/1987 | Anderson | 104/124 |
| 4,665,830 | A * | 5/1987 | Anderson et al. | 104/124 |
| 5,159,993 | A * | 11/1992 | St-Germain | 182/82 |
| 5,337,908 | A * | 8/1994 | Beck, Jr. | 212/312 |
| 5,423,396 | A * | 6/1995 | Fahrion | 182/36 |
| 5,456,410 | A * | 10/1995 | Chow | 238/10 R |
| 5,707,199 | A * | 1/1998 | Faller | 414/239 |
| 5,857,543 | A * | 1/1999 | Shalders | 182/179.1 |
| 6,029,104 | A * | 2/2000 | Kim | 701/20 |
| 6,125,765 | A * | 10/2000 | Loomer | 104/89 |
| 6,149,366 | A * | 11/2000 | Deandrea | 414/279 |
| 6,234,303 | B1 * | 5/2001 | Gales et al. | 198/817 |
| 6,269,749 | B1 * | 8/2001 | Hogg | 104/53 |
| 6,269,750 | B1 * | 8/2001 | Cornwell et al. | 104/53 |
| 6,493,921 | B1 * | 12/2002 | Tarkington | 29/525.01 |
| 6,523,647 | B2 * | 2/2003 | Duplessis | 187/270 |
| 6,523,957 | B1 * | 2/2003 | Walton et al. | 352/243 |
| 6,652,213 | B1 * | 11/2003 | Mitchell et al. | 414/284 |
| 6,953,377 | B2 * | 10/2005 | Quercetti | 446/168 |
| 7,131,382 | B2 * | 11/2006 | Gordon | 104/53 |
| 7,743,710 | B2 * | 6/2010 | Gordon | 104/53 |
| 7,991,505 | B2 * | 8/2011 | Lert et al. | 700/214 |
| 8,453,577 | B2 * | 6/2013 | Gordon | 104/53 |
| 8,453,578 | B2 * | 6/2013 | Beutler | 104/53 |
| 8,641,542 | B2 * | 2/2014 | Kitchen et al. | 472/45 |
| 8,721,250 | B2 * | 5/2014 | Razumov | 414/281 |
| 2004/0083922 | A1 * | 5/2004 | Gnezdilov | 104/124 |
| 2007/0240937 | A1 * | 10/2007 | Borgstede | 182/129 |
| 2008/0247848 | A1 * | 10/2008 | Freudelsperger | 414/277 |
| 2010/0211238 | A1 * | 8/2010 | David, Jr. | 701/20 |
| 2010/0307868 | A1 * | 12/2010 | Bennett et al. | 182/36 |
| 2012/0177465 | A1 * | 7/2012 | Koholka | 414/279 |
| 2013/0019771 | A1 * | 1/2013 | Gmeinwieser et al. | 104/53 |
| 2014/0086714 | A1 * | 3/2014 | Malik | 414/273 |

* cited by examiner 501
4B
6
51

501
4B
6

4VL
4L 52
501
4B
6
4VL 51A
51B
572
5
51
5126A
5127A
5126B
5127B

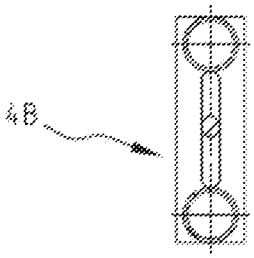
FIG. 6B
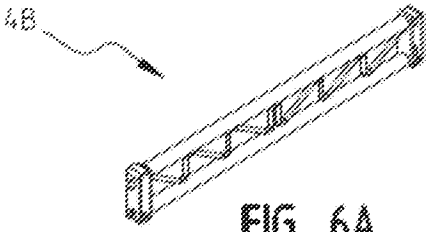
FIG. 6A
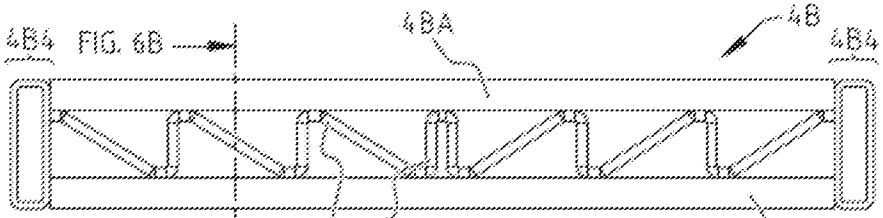
FIG. 6E
FIG. 6C
FIG. 6D
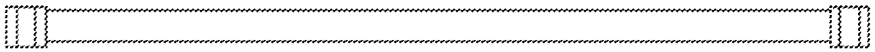
FIG. 6F

SCAFFOLD WITH SCAFFOLDING ELEMENTS AND METHODS FOR ERECTION THEREOF

The present invention relates to the field of scaffolding constructions, elements thereof and methods for erection thereof.

BACKGROUND

It is known that erection and dismantling of a scaffold is very labour-intensive. This means that a relatively large amount of time is lost in the erection of particularly larger scaffolds. The physical load for people erecting the scaffold is further a heavy one, so that many people can only perform this task for a limited part of their life.

There is a need for scaffold systems which can be erected and dismantled relatively quickly.

SUMMARY OF THE INVENTION

It is an object of the present invention to provide a scaffold, scaffolding elements and methods for erecting a scaffold which solve at least one of the above stated problems.

The Belgian patent applications BE 20100443 and BE 20100442, respectively titled "A lift unit for scaffold, methods for ascending and descending in a scaffold with the lift unit, methods for erecting a scaffold and methods for dismantling a scaffold" and "Lift system for a scaffold", both in the name of applicant and both filed on 16 Jul. 2010, describe respectively a climbing lift or scaffold lift and a lift cage for use in a scaffold. These applications are incorporated here by reference.

BE 20100443 describes a lift unit or climbing lift generically as:

a lift unit for ascending and descending in a shaft formed by a scaffold column of a scaffold, the scaffold column comprising at least one scaffold section, each scaffold section being defined by uprights and ledgers, comprising a first part adapted to enable fixing at different heights to the scaffold by means of a first set of fixing means;

a second part adapted to enable fixing at different heights to the scaffold by means of a second set of fixing means;

a distance control means adapted to drive a variation in the distance between the first set of fixing means and the second set of fixing means.

BE20100442 describes a lift system generically as:

a lift system for use in a scaffold column of a scaffold, the scaffold column comprising at least one scaffold section, each scaffold section being substantially defined by uprights and ledgers, the lift system comprising:

a lift unit;

a frame which is adapted for mounting on a part of the scaffold and which is adapted to carry a lifting means internally on the scaffold column; and a lifting means which is adapted at a first outer end thereof to be coupled to the frame and is adapted at a second outer end thereof to be coupled to the lift unit, and which is adapted to control the ascent or descent of the lift unit in the scaffold.

The above stated applications also specify a guide system for a carrier unit or lift unit adapted to be mounted on the ledgers of the scaffold and adapted for coupling to the displacing means (e.g. wheel mechanisms) of a carrier unit or lift unit. They describe lifts which can be provided with displacing means. The displacing means can comprise a number of (for instance four) wheel mechanisms which can optionally be driven and which are adapted to move (for instance travel) on a rail system which can be arranged through the scaffolding construction at a determined ledger level (for instance ground level). This lift unit can in this way be readily displaced through the whole scaffolding construction via the determined level (for instance ground level), particularly to adjacent scaffold columns. This rail system preferably comprises at least two rails which are adapted for mounting on the ledgers of the scaffold, and which are on the other hand adapted for coupling to the displacing means of the lift unit (for instance to wheels of the wheel mechanisms of the lift unit).

It is further stated that, for instance when the lift unit itself does not comprise wheel mechanisms or other displacing means, the above described rail system can also be combined with an autonomous carrier unit (e.g. a carrier trolley) which can be placed in the scaffold and which comprises the above described wheel mechanisms or other displacing means for guiding along the rail system through the scaffold and on which the lift unit can rest.

In a first aspect of the present invention a scaffold is described comprising at least two horizontally adjacent scaffold sections, wherein the scaffold sections are defined substantially by lengthwise ledgers, transverse ledgers and uprights, and wherein the scaffold comprises a guide means adapted to be able to displace in substantially horizontal direction therealong a displaceable platform corresponding thereto and guided thereby. The displacement can preferably take place through a distance greater than the width of one scaffold section.

In embodiments of the present invention a scaffold is described wherein the guide means is adapted to allow a further erection of the scaffold when it is arranged on a present highest level of the scaffold.

In embodiments of the present invention a scaffold is described in which the guide means and the corresponding displaceable platform are adapted to enable displacement of the platform substantially inside and through the at least two mutually adjacent scaffold sections.

In embodiments of the present invention a scaffold is described in which the guide means comprises at least one rail arranged in a direction parallel to the lengthwise ledgers.

In embodiments of the present invention a scaffold is described in which the guide means comprises two rails arranged in a direction parallel to the lengthwise ledgers.

In embodiments of the present invention a scaffold is described in which the lengthwise ledgers at least partially form the guide surface of the rails.

In embodiments of the present invention a scaffold is described in which the lengthwise ledgers run along the inner side of the scaffold sections defined by respective uprights. The uprights of the scaffold are typically all identical. The uprights preferably have a square or rectangular cross-section and comprise on at least one, but preferably each, of the four side surfaces at least one column of successive holes at regular distances from each other. These columns of holes preferably lie in a line running parallel to the longitudinal direction of the uprights. At least one pair of diametrically opposite longitudinal surfaces of the uprights preferably has aligned columns of holes, so that it is possible to place for instance a threaded rod, pin or bolt through the upright.

In embodiments of the present invention a scaffold is described in which the lengthwise ledgers are fixed to respective support means, the support means themselves being fixed to the uprights at an appropriate height and being adapted for coupling to the ledgers. The support means are preferably secured by means of bolts which can be arranged through aligned holes in diametrically opposite longitudinal surfaces of the upright.

In embodiments of the present invention a scaffold is described in which each of the support means itself comprises a rail part, the rail parts forming together with the lengthwise ledgers two substantially uninterrupted rails.

In embodiments of the present invention a scaffold is described in which the length of the rail parts comprised in the support means is substantially greater than the width of an upright. This for at least several of the support means (for instance support blocks or a half support block type).

In embodiments of the present invention a scaffold is described in which the length of the rail parts comprised in the support means is substantially equal to the width of an upright.

In embodiments of the present invention a scaffold is described in which at least one outer end of a rail part comprised in the support means of an upright protrudes substantially outside a plane defined by the corresponding upright and another upright which are connected to each other by means of a transverse ledger.

In embodiments of the present invention a scaffold is described in which the rail part of the support means protrudes over a distance greater than 40 cm, greater than 50 cm, greater than 60 cm. The rail part can for instance protrude about 50 cm or about 60 cm or about 70 cm on one or both sides of the scaffold. Allowing the rail parts to protrude leaves space available on a climbing lift or workfloor where a worker can take up position adjacently of substantially horizontally stacked scaffolding material, such as for instance lengthwise ledgers.

In embodiments of the present invention a scaffold is described in which the guide surface of the rails and of possible rail parts of the support means are formed substantially by two elongate, rectangular surfaces lying substantially at a right angle.

In embodiments of the present invention a scaffold is described in which the guide surface of the rails and of possible rail parts of the support means are formed by elongate rods of square cross-section.

In embodiments of the present invention a scaffold is described wherein these rods, when the rails are mounted horizontally in appropriate manner in the scaffold, comprise two diagonally opposite longitudinal ribs running in the same vertical plane. The other two ribs are then situated in the same horizontal plane. In this case the use of a spacer is not necessary between the rods and the rest of the ledgers or support blocks. Production is easier and allows the use of simple and efficient locking mechanisms, which can be used to secure a displaceable platform against release. Such a mechanism can for instance engage under the edge of the two ribs in the same horizontal plane.

In embodiments of the present invention a scaffold is described in which the outer ends of the lengthwise ledgers are fixed to the respective support means by means of substantially two fixing points, such as for instance threaded rod elements fixed to the support means and corresponding nuts which can tighten the outer end of the lengthwise ledgers against the respective support means, wherein each of the outer ends of the lengthwise ledgers comprise two guide slots which are adapted, during placing of the ledger, to be able to successively receive respectively the first fixing points, such as threaded rod elements, and the second fixing points, such as threaded rod elements, without changing the position of the respective fixing points (threaded rod elements) before the outer ends of the lengthwise ledgers are tightened against the respective support means.

In embodiments of the present invention a scaffold is described in which, after the first fixing point, e.g. threaded rod element, has been received by the first guide slot, the first fixing point, e.g. threaded rod element, can serve temporarily as sole support point for the ledger.

In embodiments of the present invention a scaffold is described in which at least two adjacent support means are further connected in the width direction of the scaffold by means of a respective transverse ledger, this transverse ledger being adapted such that the forward movement of the displaceable platform along the guide means is not obstructed. The transverse ledger is arranged here at a height which is lower than the height of the top side, or even lower than the height of the underside of the lengthwise ledgers.

In embodiments of the present invention a scaffold is described comprising at least one fold-up diagonal.

In embodiments of the present invention a scaffold is described in which the fold-up diagonal comprises four arms, such as for instance rods, which are each connected at a first outer end to a shared rotation means and at another outer end to suitable locations on the scaffold. Suitable locations can for instance be holes in the uprights or connection points to associated support means.

In embodiments of the present invention a scaffold is described which further comprises a climbing lift or lift cage or is adapted for co-action therewith, for the purpose of carrying scaffolding material up and downward in a scaffold column, for instance as described in BE20100443 and BE20100442.

In alternative embodiments of the present invention a scaffold is described in which the one or more rails are mounted on the transverse ledgers.

In embodiments of the present invention is described a method for erecting a scaffold, the scaffold comprising at least two horizontally adjacent scaffold sections, the scaffold sections being defined substantially by lengthwise ledgers, transverse ledgers and uprights, comprising of:

erecting a first level of a scaffold, the first level comprising at least two horizontally adjacent scaffold sections;

erecting a second level of the scaffold on top of the first level; further comprising of arranging a guide means for the second level during the erection of the first level of the scaffold, the guide means being adapted to enable displacement of a corresponding displaceable platform therealong in substantially horizontal direction;

displacing the displaceable platform along the guide means during erection of the second level.

In embodiments of the present invention a method is described further comprising of a. arranging a lift platform in the first level of the scaffold;

b. ascending to the second level of the scaffold with the lift platform, the lift platform carrying scaffolding material suitable for further erection of the scaffold.

According to embodiments of the present invention a horizontally mobile platform is described which is adapted for guiding by guide means, for instance travel rail ledgers and support blocks according to embodiments of the present invention.

According to embodiments of the present invention the mobile platform preferably comprises a number of wheel devices, for instance four, six or eight wheels. Two, three or four aligned wheel devices can for instance be present on each of the sides in the longitudinal direction of the mobile platform. In determined embodiments of the present invention these wheel devices can be retracted and extended in a direction substantially perpendicular to the longitudinal direction of the mobile platform typically corresponding to the longitudinal direction of the scaffold. This can in specific cases simplify the installation, storage or passage of the platform.

According to embodiments of the present invention, and possibly in combination with the embodiment comprising wheel devices which can be retracted and extended, the mobile platform comprises a first floor part adapted to receive a person, and a second floor part adapted to stock material such as scaffolding material, construction material or other material and to be carried upward relative to (moved a distance from) the first floor part. By moving the second floor part upward relative to the first floor part on which the person is present, this latter need not bend forward all the time and himself lift the whole weight of the material such as the scaffolding material during erection of the scaffold. In determined embodiments the second floor part is located centrally in the mobile platform and the platform comprises for instance two first floor parts, each at a different outer end of the second floor part, at the outer end of the mobile platform.

The wheels of the mobile platform can be driven manually or mechanically by means of a drive mechanism.

In a second aspect of the present invention a ledger for use in a scaffold is described which comprises at each of its outer ends a coupling means comprising guide slots adapted to be able, during placing of the ledger, to successively receive respectively a first fixing point, e.g. threaded rod element, and a second fixing point, e.g. threaded rod element, which are located at fixed positions of a scaffolding element. This scaffolding element can preferably be a support means, such as for instance a support block. The ledger can be a width ledger (also referred to as transverse ledger) or lengthwise ledger of the scaffold.

In embodiments of the present invention a ledger is described in which the guide slots are provided in a coupling plate which is substantially flat and the main surface of which lies perpendicularly of the longitudinal direction of the ledger and in which the fixed positions of the first and second fixing point (e.g. threaded rod element) are such that they run substantially parallel to the longitudinal direction of the ledgers when the guide slots receive the fixing points (e.g. threaded rod elements) and a coupling is thus formed between the ledger and the associated scaffolding element.

In embodiments of the present invention a ledger is described wherein the two fixing points are a lower fixing point and an upper fixing point, the upper fixing point being placed higher than the lower one, and wherein the two slots are also a lower slot and an upper slot, the upper slot lying higher than the lower one.

In embodiments of the present invention a ledger for use in a scaffold is described in which the lower slot is substantially straight and extends substantially vertically upward through a predetermined distance from a lower edge of the coupling plate.

In embodiments of the present invention a ledger is described in which the upper slot extends from a lateral edge of the coupling plate and comprises an entry opening lying at a height adapted to correspond to the predetermined position of the second fixing point relative to the first fixing point.

In embodiments of the present invention a ledger is described in which the upper slot further extends in an upward curving circular arc corresponding to a rotation of the ledger round the first fixing point.

In embodiments of the present invention a ledger is described in which the coupling plate comprises a recess on the rear side close to the outer end of the arcuate upper slot which can receive a nut coupled to the upper threaded rod element, this preferably, in a manner such that the threaded rod element-nut connection, in the possible case it comes loose, resulting in the ledger possibly rotating away, would be blocked by the recess.

In embodiments of the present invention a ledger is described in which the upper slot extends further upward in curved manner, wherein the positions of the outer ends of the lower slot and of the upper slot are adapted to each other such that they can simultaneously receive the respective first fixing points and second fixing points close to their respective outer ends, and wherein an upper guide surface of the upper slot has a local downward directed dip or protrusion, which in the first instance blocks the passage of the second fixing point in the second slot following a limited receiving of the second fixing point by the second slot as a result of rotation of the ledger around the first fixing point, wherein the blocking of the second fixing point by the dip can be released by slightly lifting the ledger close to the respective coupling means through a distance smaller than the length of the lower slot and performing a further rotation of the ledger around the first fixing point.

In embodiments of the present invention a ledger is described comprising at the top a guide surface for guiding the movement of a corresponding displaceable platform.

In embodiments of the present invention a ledger is described in which the guide surface is formed by substantially two elongate rectangular surfaces lying substantially at a right angle.

In embodiments of the present invention a ledger is described in which the guide surface is formed by an elongate rod of square cross-section, the elongate rod being connected at its outer ends to the coupling means.

In embodiments of the present invention a ledger is described wherein the rod, when the ledger is mounted in the scaffold, comprises two diagonally opposite longitudinal ribs running in the same vertical plane. In embodiments of the present invention a ledger is described in which the rod is connected to the coupling means above the second slot.

In embodiments of the present invention a ledger is described of the double ledger type, wherein under the first rod a second rod mutually connects the two coupling means, and wherein the first rod and the second rod are connected to each other in between.

In embodiments of the present invention a ledger is described in which the second rod is connected to the coupling means between the first and the second slot.

In embodiments of the present invention a ledger is described in which the second rod is situated at a substantially constant distance below a straight first rod apart from close to its outer ends where this distance becomes smaller, in order to enable coupling to the coupling means above the lower slots.

In embodiments of the present invention the use of a ledger in a scaffold as lengthwise ledger is described, wherein the length of the ledger is substantially smaller than the distance between the two uprights it helps to connect.

In embodiments of the present invention the use of a ledger in a scaffold as lengthwise ledger is described, wherein the lengthwise ledgers are connected to the uprights by means of accessories such as support blocks connected to the respective uprights.

In a third aspect of the present invention a support means is described for use in the erection of a scaffold, wherein the support means is adapted to enable connection to an upright and to enable connection to at least one lengthwise ledger of the scaffold. Such a support means can be attached to an upright during the erection of a scaffold before making couplings to width and/or lengthwise ledgers.

In embodiments of the present invention a support means is described which is further adapted to enable connection to a width ledger of the scaffold.

In embodiments of the present invention a support means is described which further comprises a ledger part which, when the support means is connected to an upright in a scaffold, protrudes substantially at least on one side in the longitudinal direction of the scaffold out of the plane defined by the upright to which the support means is connected and the adjacent upright in the width direction.

In embodiments of the present invention a support means is described which comprises a ledger part of a lengthwise ledger which, when the support means is connected to an upright in a scaffold, protrudes substantially on both sides in the longitudinal direction of the scaffold out of the plane defined by the upright to which the support means is connected and the adjacent upright in the width direction.

In embodiments of the present invention a support means is described in which the ledger part protrudes at least 30 cm, at least 40 cm, at least 50 cm, at least 60 cm on one or both sides.

In embodiments of the present invention a support means is described in which the outer ends of the ledger part are adapted to enable connection to a ledger for the scaffold.

In embodiments of the present invention a support means is described in which the outer ends of the ledger parts comprise a first and a second fixing point, e.g. threaded rod element, at fixed positions, the longitudinal direction of which is parallel to the longitudinal direction of the ledger part.

In embodiments of the present invention a support means is described in which the outer ends of the ledger parts comprise a coupling plate which is substantially flat, and the main surface of which lies perpendicularly of the longitudinal direction of the ledger part, the coupling plate comprising the first and the second fixing points.

In embodiments of the present invention a support means is described in which the support means comprises a first and a second fixing point for the purpose, when coupled to an upright, of being coupled to a width ledger.

In embodiments of the present invention a support means is described in which the ledger part is adapted so that it can form part of a guide means through a scaffold along which a corresponding displaceable platform guided thereby can be displaced in substantially horizontal direction.

In embodiments of the present invention a support means is described in which the guide surface of the ledger part is formed by substantially two elongate rectangular surfaces lying substantially at a right angle.

In embodiments of the present invention a support means is described in which the guide surface of the ledger part is formed by elongate rods of square cross-section.

In embodiments of the present invention a support means is described wherein these rods, when the support means are mounted in the scaffold, comprise two diagonally opposite longitudinal ribs running in the same vertical plane.

In embodiments of the present invention a support means is described in which each threaded rod element is provided with a corresponding nut, and further comprising a removable blocking means which prevents undesired release of the nut from the threaded rod element.

In embodiments of the present invention a scaffold is described wherein at least one upright of square cross-section comprises holes in at least two opposite longitudinal surfaces, to which holes two support means according to any of the foregoing embodiments are connected. By arranging support means on for instance the internal side of the upright and on the external side (being on the outer side of the scaffold; optionally using shared bolts but for instance also at different heights using different bolts) for two successive uprights in the longitudinal direction, a lengthwise ledger can be externally connected to these successive uprights. This can take place on both the front and the rear side of the scaffold for the same scaffold section or scaffold column. A locally wider scaffold section or scaffold column can in this way be constructed, this being useful for instance when a lift system is used in this column in combination with a separately displaceable platform in the form of a mobile trolley (see FIG. 10).

In a fourth aspect of the present invention a stabilizing element for use in a scaffold, a so-called fold-up diagonal, is described comprising at least two arms or rods which can be oriented relative to each other and which are each connected at a first outer end to a shared folding means and comprise at another outer end a connecting means adapted for fixing to elements of the scaffold.

In embodiments of the present invention a stabilizing element for use in a scaffold is described comprising at least four arms or rods which can be oriented relative to each other and which are each connected at a first outer end to a shared folding means and comprise at another outer end a connecting means adapted for fixing to elements of the scaffold.

In embodiments of the present invention a stabilizing element for use in a scaffold is described which is adapted to be able to orient the arms such that they come to lie substantially parallel, wherein their first outer ends and their second outer ends coincide. The two or four arms or rods can thus be folded together so that they become shorter and can still be stocked horizontally.

In embodiments of the present invention a stabilizing element for use in a scaffold is described in which the orientation means comprises a central ring structure and wherein the first outer ends of the arms comprise a ring structure, which arms are each connected to this ring as chain links (interconnected links). This provides for a strong connection and allows folding together of the two or four arms.

In embodiments of the present invention a stabilizing element for use in a scaffold is described in which the second outer ends of the arms are adapted so that they can be attached to the uprights of the scaffold.

In embodiments of the present invention a stabilizing element for use in a scaffold is described in which the second outer ends of the arms are adapted so that they can be attached to support means for ledgers of the scaffold, the support means being fixed to respective uprights.

In embodiments of the present invention a stabilizing element for use in a scaffold is described in which the second outer ends of the arms are adapted for fixing to holes in the uprights or support means by means of a fixing means such as a threaded rod element or a pin.

In embodiments of the present invention a scaffold is described comprising at least one scaffold section and at least one stabilizing element as described above, wherein each of the second outer ends of the arms of the stabilizing element is secured close to one of the four corners of the front plane of a scaffold section formed by the two uprights and two lengthwise ledgers defining the plane. The use of such diagonals allows the stability of the scaffold to be increased, and the diagonals can be stocked horizontally.

The fold-up diagonals with four arms do in fact comprise two diagonals in one and provide for an extra strength of the scaffold structure which has often been realized in the prior art by placing diagonals in the width direction. In embodiments of the present invention this is not possible or is so to only limited extent, since mobile platforms are used.

In embodiments of the present invention a scaffold is described in which the central ring structure lies in a plane substantially parallel to the front plane of the scaffold.

Reference is made in the context of this description to fixing points. In preferred embodiments these fixing points are a threaded rod or threaded rod element. These threaded rod (elements) can for instance also be bolts or bolt elements, such as for instance an outer end of a bolt comprising screw thread. The use of alternative fixing means or coupling means which replicate the functionalities as described for the bolts (or threaded rods) and nuts for the present invention is not precluded.

Further aspects of the present invention are described in the sub-claims. The features of the sub-claims, features of any of the sub-claims and any of the features of other sub-claims can be combined and be deemed suitable by the skilled person and not only in the specific combinations as defined by the claims.

BRIEF DESCRIPTION OF THE DRAWINGS

The accompanying drawings are used to illustrate embodiments of the present invention.

FIGS. 6A to 6F illustrate embodiments of a connecting ledger according to embodiments of the present invention.

FIG. 6A shows a perspective view, FIG. 6B a cross-sectional view along line C-C in FIG. 6C. FIG. 6C is a side view. FIGS. 6D and E are end views of the ledger. FIG. 6F is a top view.

FIGS. 9A and 9B show a front view and a cross-sectional view in the direction A-A indicated in the front view of a coupling plate of a support block, or extension ledger. The coupling means of a half support block is similar.

DESCRIPTION OF THE ILLUSTRATIVE EXAMPLES

The above stated and other advantageous features and objects of the invention will become more apparent and the invention better understood from the following detailed description when read in combination with the respective drawings.

The description of the aspects of the present invention is given by means of specific embodiments and with reference to, but not limited to, specific drawings. The figures shown are only schematic and should be deemed as non-limitative. Determined elements or features may for instance be shown out of proportion or scale in relation to other elements.

Figure 1A:
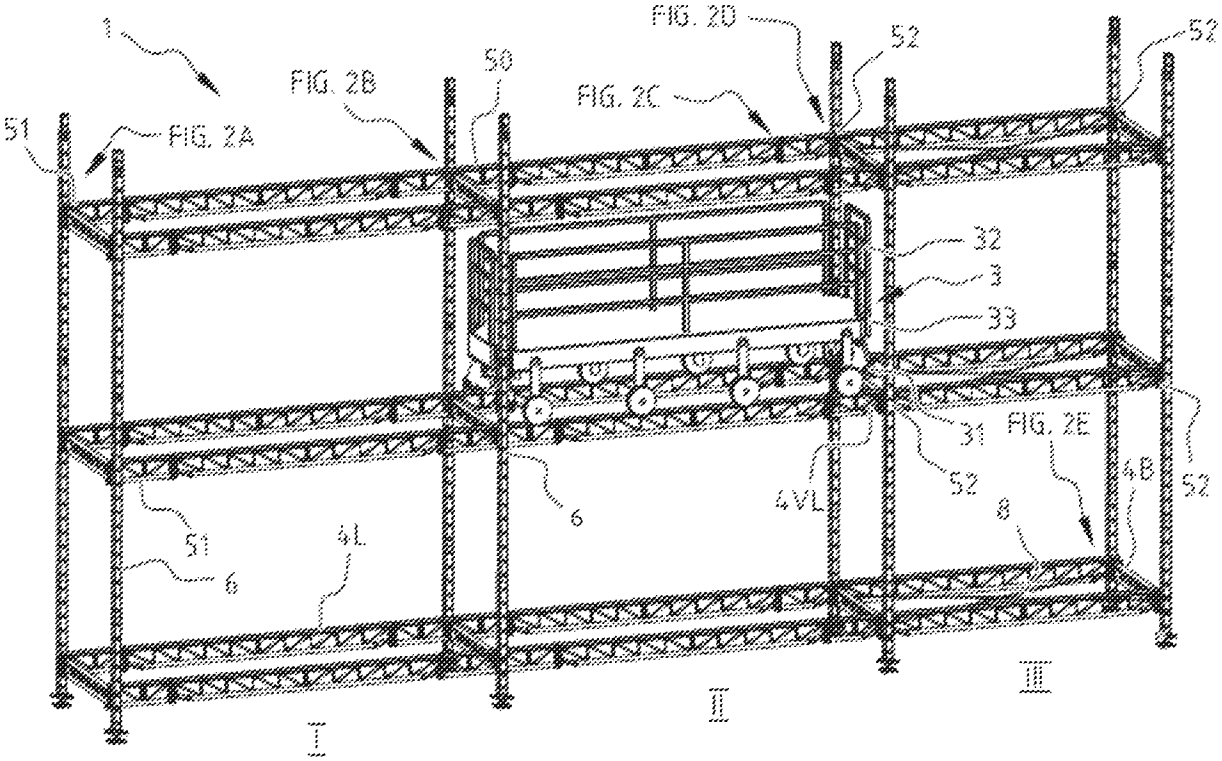
FIG. 1A is a perspective view of a scaffold concept according to embodiments of the present invention.

FIG. 1A shows a scaffold according to preferred embodiments of the present invention. The scaffold comprises rows and columns (I, II, III) of scaffold sections. Each of these scaffold sections is defined substantially by corresponding uprights 6, lengthwise ledgers 4L and transverse ledgers 4B. The scaffold sections can further be strengthened by the use of diagonals 8. At the bottom the uprights typically comprise a foot jack 7.

According to preferred embodiments of the present invention, ledgers 4L, 4B are connected to support means or support ledger 50 and support blocks 51, and 52. An extension ledger 4VL can also be arranged between for instance a support block 52 and a main ledger 4L. These support blocks 51, 52 and support ledger 50 are in turn connected to uprights 6. Support blocks 51, 52 and support ledger 50 are further also adapted for coupling to ledgers 4B which mutually connect two adjacent uprights in the width direction. The use of support blocks 51, 52 and support ledgers 50 allows arrangement of the ledgers within the section defined by their respective uprights; in other words, the ledgers can be positioned on the interior of the scaffold defined by the uprights, i.e. on the side of the uprights pointing inward into the scaffold. These ledgers are preferably also adapted to serve as guide means for a platform guided displaceably thereby. The displaceable platform, typically comprising a wheel device 31, a work-floor 33 and a rail 32, can be displaced over this guide surface of the lengthwise ledgers. This by allowing co-action of the wheels of wheel device 31 with the rails formed by, among other parts, the lengthwise ledgers and parts of the support blocks. The support blocks can themselves be provided for this purpose with a rail part or ledger part which, together with a guide surface of ledgers 4L, form a continuous rail through the scaffold construction at a determined ledger level. This is possible for instance at each ledger level. A mobile platform can take the place of the work-floors for a specific scaffold level. Different types of support blocks are described here; the narrow support blocks 52, the half support blocks 51 and support ledgers 50. These elements will be described in more detail below. The displaceable platform is preferably a lift cage or a climbing lift as described respectively in the Belgian patent applications 2010/0442 and 2010/0443. Described in BE2010/0442 of these applications is a so-called climbing lift which allows ascent and descent in a scaffold. During ascent or descent in the scaffold this climbing lift can transport construction material for the scaffold. In BE2010/0443 a lift cage is described as an alternative platform allowing movement up and downward in vertical direction in a scaffold column. These respective climbing lift or lift cage devices are then preferably provided with guide means 31 which can co-act with the rails formed by lengthwise ledgers 4L and the respective support blocks 51, 52 or support ledgers 50. The horizontally displaceable platform 3 is preferably also a vertically displaceable platform, or it can be displaced on a vertically displaceable platform (and carried into the scaffold from the vertically displaceable platform).

In embodiments according to aspects of the present invention it is possible to erect a scaffold in an alternative, rapid and efficient manner using an above stated climbing lift or alternative device which allows vertical transport of material in a scaffold column. In order to illustrate the idea we shall assume that scaffold column II is a column in which displaceable platform 3 can be displaced vertically.

During erection of prior art scaffolds the lengthwise ledgers typically extend from upright to upright, or they extend at least from their first outer end located close to the first upright (for instance the rosette of a Layher™ upright) to a similar position on an adjacent upright. The lengthwise ledgers are difficult to stack horizontally here without leaving essential space clear for the personnel erecting the scaffold. Stacking of the scaffold material at an angle or vertically is less obvious. By using support blocks in the form of support ledgers 50 or half support blocks 51 the overall distance between two adjacent uprights in the longitudinal direction can be made substantially greater than the standard length of a lengthwise ledger 4L. When such ledgers are stacked horizontally on the climbing lift or an alternative work-floor which can travel on the rails, a person can be placed on both sides of the horizontally stacked ledgers 4L. Together they can easily lift ledger 4L upward and couple it to the support blocks.

Because the displaceable platform 3 can displace along the rails at a determined level in substantially horizontal direction, a complete row of scaffold sections can be erected quickly and efficiently by travelling with a displaceable platform 3 on the upper ledgers of the underlying row of scaffold sections. Once a subsequent level of scaffold sections has been erected in such manner, the displaceable platform 3 can preferably be re-placed in scaffold column II. The displaceable platform 3, can then ascend a level further in the scaffold and the following row of scaffold sections can be erected in similar manner. Once the scaffold material has been used up, the displaceable platform 3 can descend via the optionally wider scaffold column II to ground level to load material for further construction. The skilled person will appreciate that the scaffold system according to aspects of the present invention is indeed a very rapid, efficient and so less cost-intensive solution for erecting scaffolding constructions.

Figure 10:
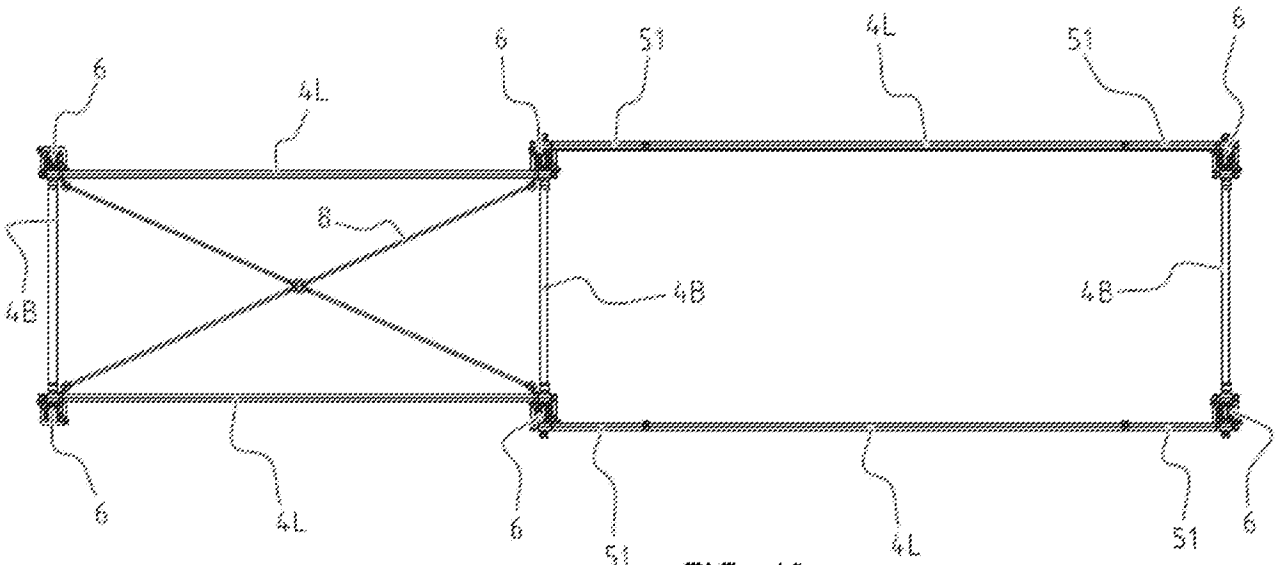
FIG. 10 shows a top view of a non-standard construction of a scaffold in which a determined scaffold column has a greater width than the standard scaffold sections.
Figures 11A, 11B, 11C, 11D, 11E:
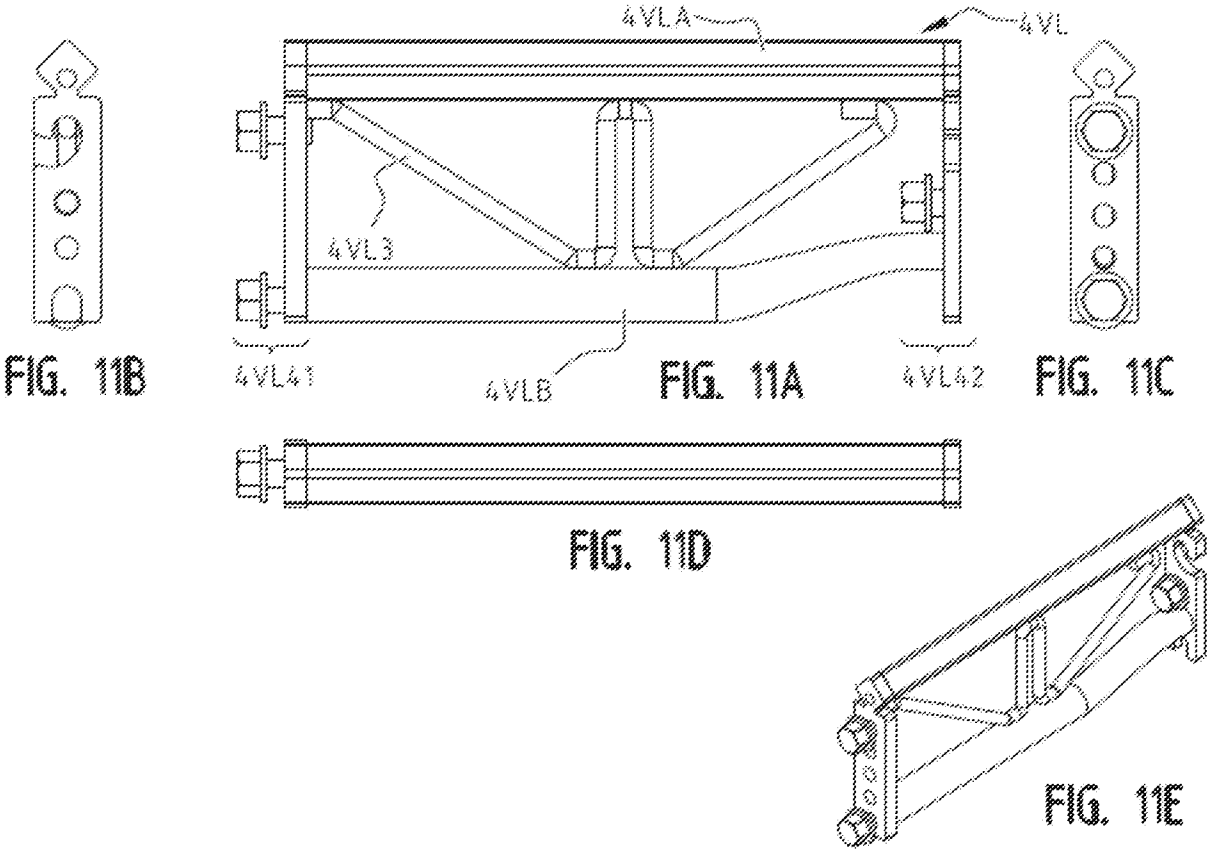
FIGS. 11A, 11D and 11E show respectively a front view, a top view and a perspective view of an extension ledger according to embodiments of the present invention.
FIGS. 11B and 11C show front views of coupling means suitable for coupling to the coupling means of the extension ledger.

Once the whole scaffold has been erected in such an efficient manner, the displaceable platform can for instance be converted to a lift cage system or lift system or, after removal of the climbing lift, such a lift system can be arranged in a determined scaffold column. The lift system preferably comprises a guide means for guiding a horizontally displaceable platform. Such a guide can for instance be realized by using rail elements of the type used for the ledgers and support blocks and arranged on a floor part of the lift system. Mobile platforms can then be arranged at one or more levels of the scaffold in order to perform determined operations on for instance a building. It is therefore no longer necessary to have to arrange work-floors in the scaffold, this resulting in quite some time-saving. These mobile platforms can be arranged permanently at specific or all levels of the scaffold during work operations. It is also possible for one or more displaceable platforms to change level in the scaffold during work operations by making use of the lift system. In determined embodiments a lift system is used in a standard scaffold construction and the horizontally displaceable platforms are adapted to retract/extend the wheels in the transverse direction. In alternative embodiments at least one wider scaffold column can be erected in which the lift system will later be arranged. The width of the platform 3 can then be relatively greater, and this allows the use of horizontally displaceable platforms having a constant wheelbase and so being of simpler construction (see FIG. 10).

In an alternative construction scenario, wherein the guide system is arranged only at a determined, e.g. the lowest, level of a scaffold, typically for use with scaffold material not per se comprising a guide system, e.g. Layher™ systems, a complete scaffold column can be erected to a predetermined height by making use of for instance a climbing lift. The climbing lift can then descend back to ground level and travel on the rails arranged in the lowest level of the scaffold to for instance the adjacent scaffold column. This can then be erected vertically in similar manner, and so on. Existing scaffolding systems can also be improved in such manner, for instance in the sense that the erection/dismantling thereof can be accelerated.

The skilled person will appreciate that embodiments of the present invention allow not only the above stated but in fact a whole range of new erection scenarios for scaffolds.

The use of a half support block 51 is typically advantageous close to an outer end of the scaffolding construction (for instance on the left or right) where no further erection is required. Support blocks 50, 51, 52 can in any case be coupled to further ledgers or extension ledgers. This can take place by means of different mechanisms, several of which are described below. The connection between width ledgers 4B and the associated support blocks 50, 51, 52 can also take place by means of the same coupling mechanisms.

Figure 1B:
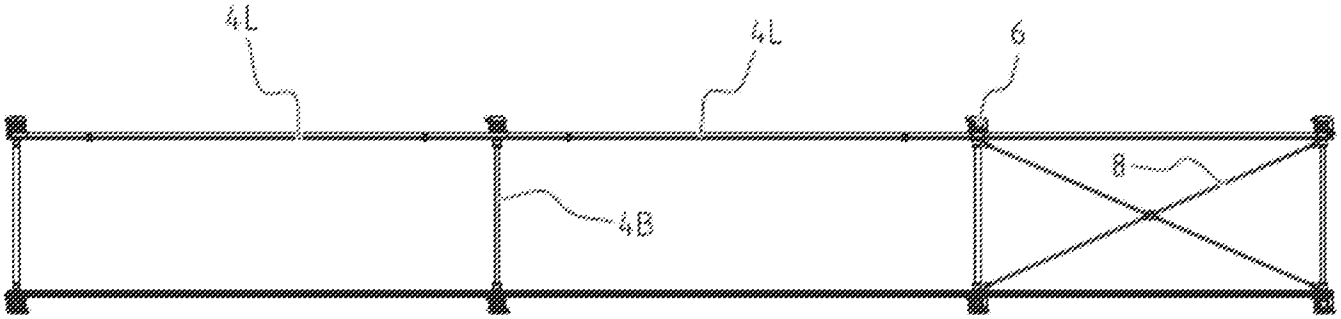
FIG. 1B is a top view of such a scaffold which shows a diagonal present in a horizontal plane in one of the sections.

FIG. 1B shows a top view of the scaffold of FIG. 1A. The section furthest to the right here comprises a diagonal according to embodiments of the present invention.

Figures 2A, 2B, 2C, 2D:
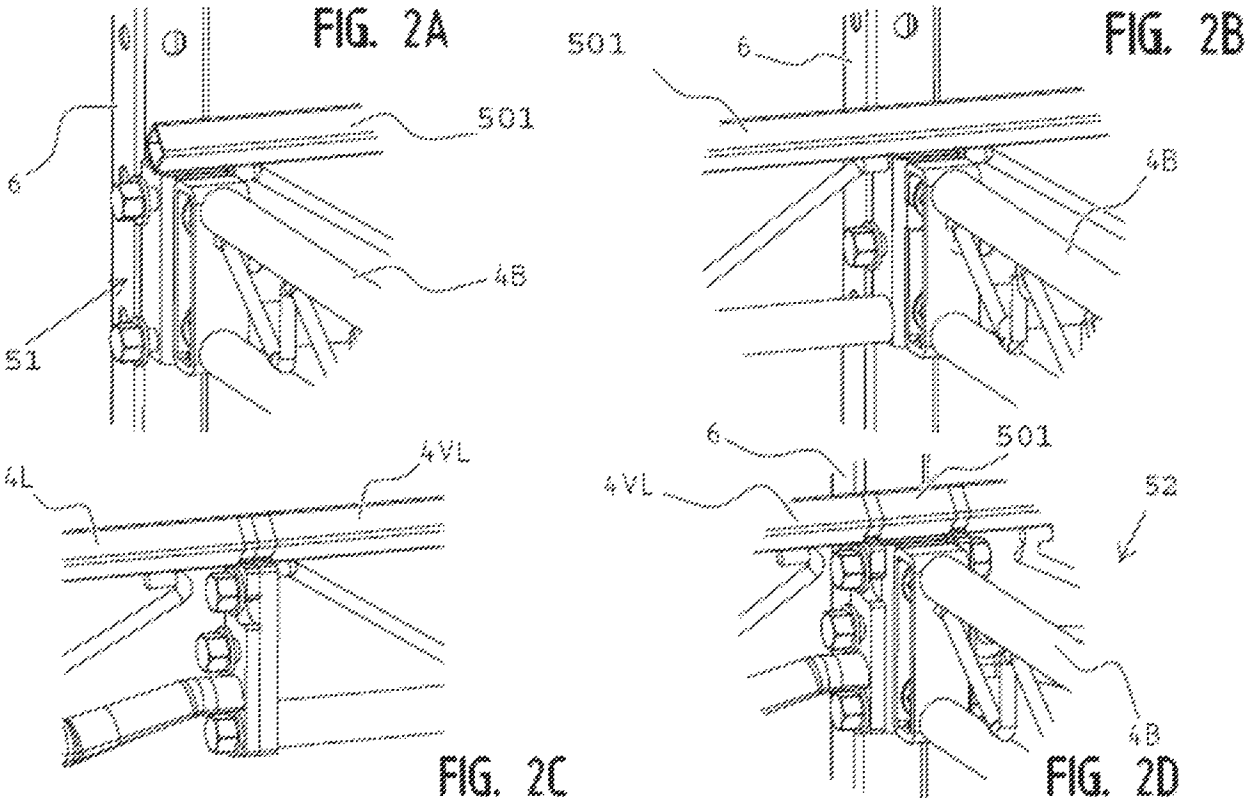
FIGS. 2A to 2I show details of FIG. 1A.
Figure 2G:
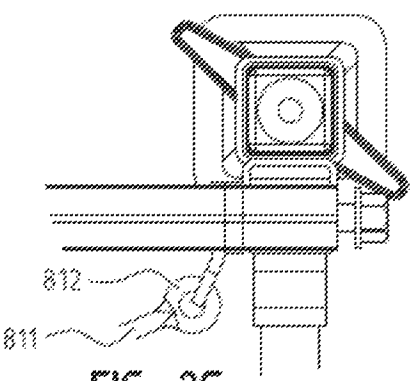
Figure 2F:
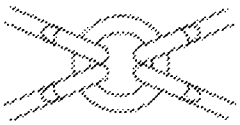
Figure 2E:
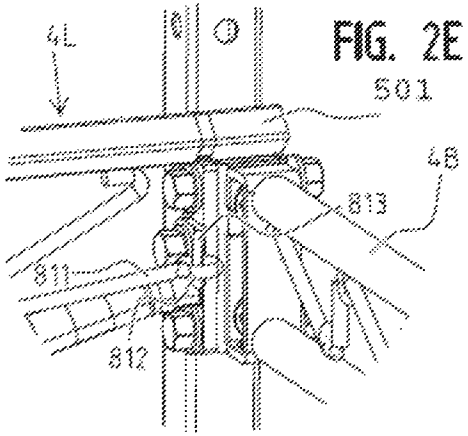
Figure 2H:
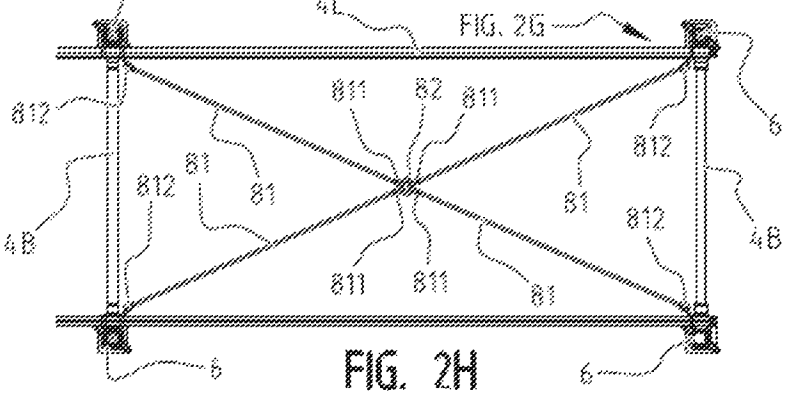
Figure 2I:
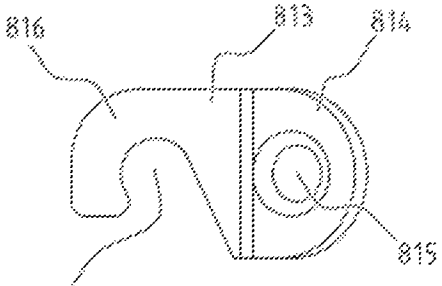

FIGS. 2A to 2G show details of FIG. 1. FIG. 2A shows a perspective view of a half support block 51 coupled to an upright 6 in the longitudinal direction of the scaffold and to a width ledger 4B in the width direction. FIG. 2B is similar but illustrates the use of a full support ledger 50. FIG. 2C shows the coupling between a lengthwise ledger 4L and an extension ledger 4VL in more detail. FIG. 2D shows the other side of extension ledger 4VL coupled to a support block 52. Support block 52 is connected to upright 6 and is coupled to a width ledger 4B. On the other side of the support block in the longitudinal direction there is a coupling to a lengthwise ledger 4L. This latter type of coupling is also shown in FIG. 2E, be it on the other side of the above-mentioned lengthwise ledger 4L.

The specific features of the different coupling means used are described in more detail below. FIG. 2E further illustrates a diagonal 8 as example of a stabilizing element. Diagonal 8 comprises at least two, and here four arms 81 (e.g. rods) which can be oriented relative to each other and which are each connected at a first outer end 811 to a shared folding means 82 and at another outer end comprise a connecting means (812, 813, 814, 815, 816, 817) which is adapted for fixing to elements of the scaffold. For this purpose the first outer end of arms 81 can for instance end in a ring structure which is connected as a chain link to a central ring 82. At the second outer ends of the orientable arms a similar ring structure 812 can for instance be coupled to a hole 815 in a coupling plate in a first part 814 of the connecting means. The connecting means can for instance also comprise a second part 816 lying for instance, though not necessarily, at an angle to first part 814 differing from 180 degrees. This angle is for instance predetermined as a function of the size of respective typical scaffold dimensions and as a function of where exactly the coupling between the coupling plate and the scaffold, for instance upright, support block or support ledger, has to take place. The angle can be determined such that the first part 814 comes to lie in line with the corresponding rod 81 when the diagonal is placed in a corresponding scaffold section. The second part typically comprises a hook-like recess 817 which allows hooking behind a threaded rod, for instance of a bolt. After such a hooking the second part 816 can be tightened against the upright by means of a nut, or the bolt, and the diagonal can be locally secured. The use of a hook-like recess allows a simple coupling to the threaded rod. This is illustrated in FIGS. 2F, 2G, 2H and 2I.

In preferred embodiments the plane in which the ring structure extends at the first outer end 811 (the plane defined by this ring structure) can for each arm 81 lie perpendicularly of the plane in which the second ring structure 812 extends. Central ring 82 and ring structures 812 can in this way come to lie in a plane parallel to the plane defined by the rectangle spanned by the diagonal in the scaffold.

The two or four arms 81 can be folded together because of the central ring structure 82, the orienting means. The length of the diagonal can hereby be reduced, this enabling horizontal stacking of the diagonal on a work platform, horizontally and/or vertically displaceable platform.

A diagonal embodied with four arms 81 as described further provides an additional stability factor when compared to the situation in which two independent diagonals were to intersect or be arranged in the vicinity of each other, since a redistribution of the forces can occur at the orienting means, e.g. the central ring 82.

Figure 3D:
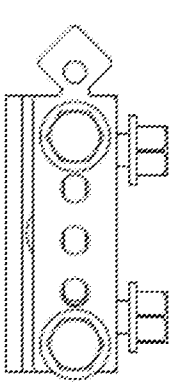
FIGS. 3A to 3D show front, top, rear and side views of a support block according to embodiments of the present invention.
Figure 3A:
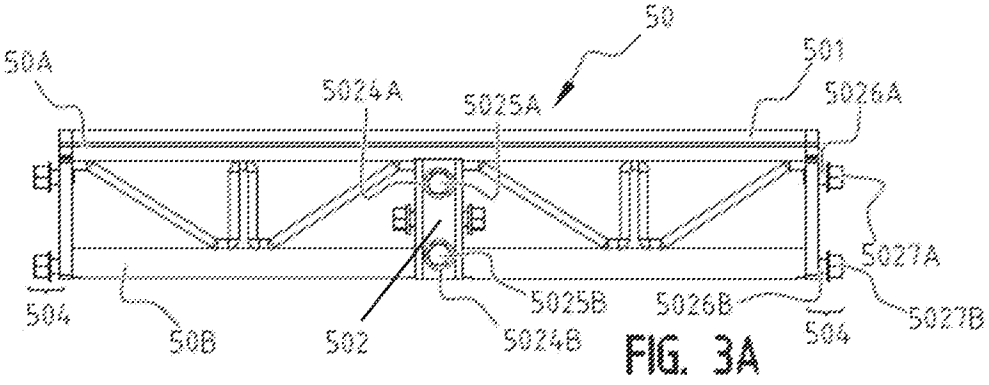
Figure 3B:
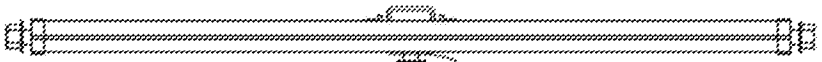
Figure 3C:
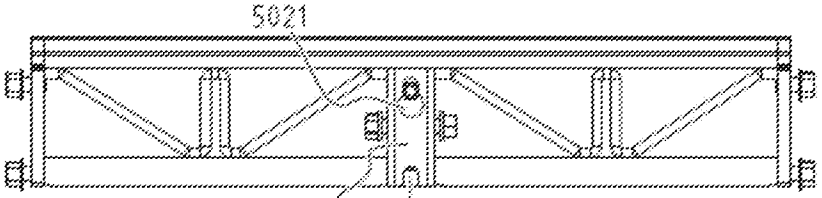
Figures 4A, 4B, 4C, 4D:
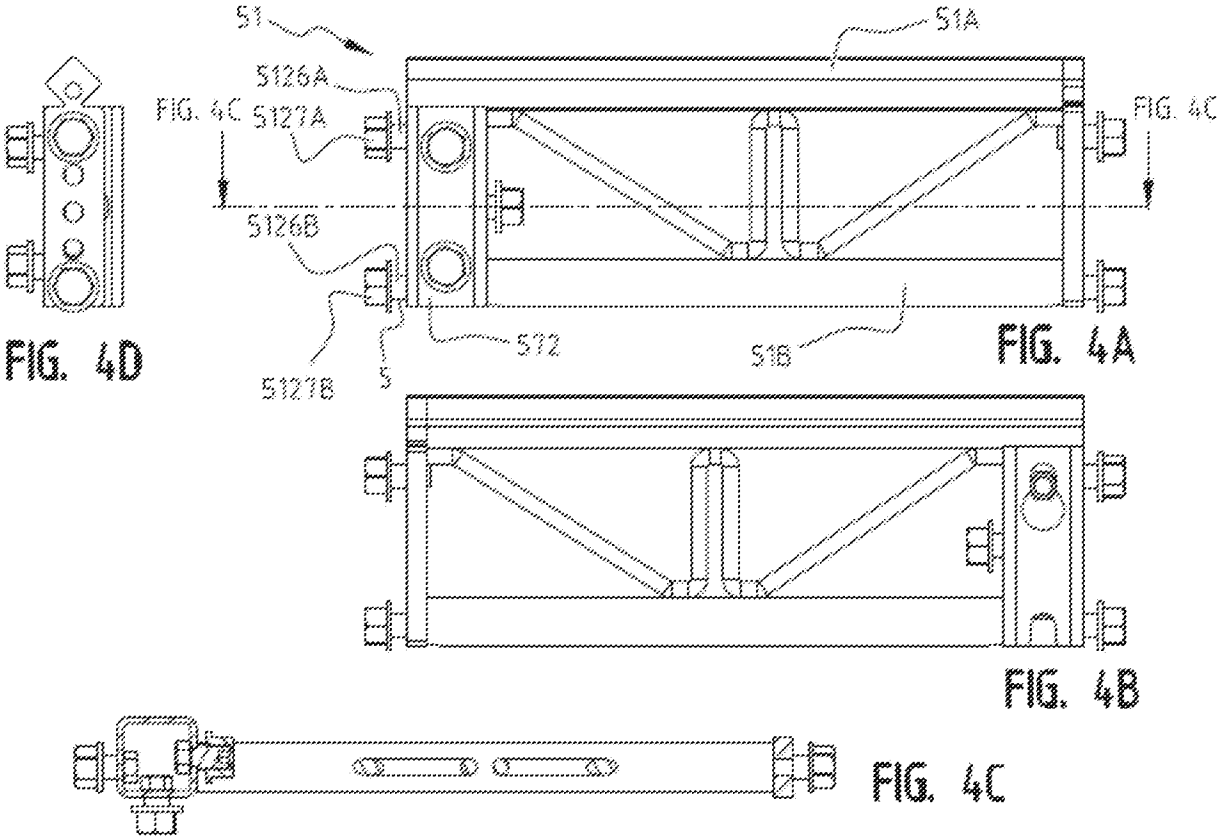
FIGS. 4A to 4D show respectively a front view, a rear view, a cross-sectional view along the line A-A in FIG. 4A and a side view of a half support block according to embodiments of the present invention.

FIGS. 3A to 3D show support ledgers 50 in more detail. FIG. 3A shows a front view, FIG. 3B a top view, FIG. 3C a rear view and FIG. 3D a side view of this support ledger. In preferred embodiments the upper surface 501 of the support ledger forms a guide surface for a displaceable platform. This is not however essential. The support ledger 50 according to this embodiment comprises a central support 502 which is provided with two recesses 5021 and 5022 on its rear side. The central support can for instance comprise a piece of hollow, square or rectangular tubing provided with the necessary openings and coupling means. Central support 502 can then be coupled using two bolts which are attached through upright 6 by coupling to respective nuts on the rear of the upright. The heads of the relevant bolts can slide here in central support 502 behind a rear surface 5023 of central support 502. By tightening the nuts on the rear of the upright the central support 502 or the support ledger 50 can thus be fixed to upright 6. The central support is further provided with a coupling means adapted for coupling to transverse ledgers 4B which will be described in further detail. This coupling means preferably comprises two threaded rod elements 5024A and 5024B which can be provided with nuts 5025A and 5025B. After coupling of threaded rods 5024A and 5024B to slots in the coupling means of transverse ledgers 4B, as will be described below, and tightening nuts 5025A and 5025B, transverse ledger 4B can be fixed to central support 502. Central support 502 is further connected to at least one elongate ledger part 50A which in determined embodiments can form a part of a rail, a guide means for a displaceable platform. This rail part 50A extends on both sides of central support 502. This can for instance be at a distance on either side of for instance 30, 40, 50, 60 or more centimeters. Provided at the outer end of ledger part 50A are coupling means for coupling to travel rail ledgers, as will be described below (in particular travel rail ledgers comprising two slots). The coupling means at both outer ends of rail part 50A here comprise a plate element provided with two threaded rod elements, a first threaded rod element 5026A situated above a second threaded rod element 5026B, to which travel rail ledgers can be coupled in similar manner as described for the coupling between threaded rod elements 5024A and 5024B. The support ledger can further also comprise a lower ledger part 50B which likewise extends on either side of central support 502 and is possibly also further connected to rail part 50A by means of additional connecting elements 503. Lower rail part 50B is also connected to central support 502 and to the coupling means at the outer ends of the support ledger, for instance using the coupling plates comprising the threaded rod elements. A strengthened support ledger or, as will be described below, a corresponding strengthened travel rail ledger is formed in this manner. Threaded rod elements 5026A and 5026B and the corresponding nuts 5027A and 5027B lie in predetermined fixed positions. This allows coupling to the coupling means at the end of travel rail ledgers which will be described below.

In preferred embodiments rail part 50A comprises a rod of square cross-section which is tilted. When the support ledger is installed in the scaffold, the rod can be connected here to the rest of the support ledger by means of one longitudinal rib, wherein this longitudinal rib and the diametrically opposite longitudinal rib lie in the same vertical plane. The two other, also diametrically opposite longitudinal ribs are then typically situated in a substantially horizontal plane. The use of such a ledger part 50A (which in determined embodiments is typically a rail part) allows a connection between ledger part 50A and the rest of the support ledger 50 to be realized in simple manner (e.g. is easily welded) and also allows a locking mechanism to be realized in simple manner between wheel device 31 of a displaceable platform 3 and ledger part 50A. Note that the chosen pitch of the relevant threaded rods 5024A, 5024B, 5026A, 5026B and of their corresponding nuts 5025A, 5025B, 5027A, 5027B is relatively large in preferred embodiments so that a small rotation of the respective nuts can provide for a fixation of the support ledger to the travel rail ledger, as will be further described.

FIGS. 4A-4D show so-called half support blocks 51. These half support blocks are wholly similar to the support ledgers 50 illustrated in FIG. 3, although parts 51A and 51B extend here along only one side of central support part 572. In the direction opposite to the direction in which ledger parts 51A and 51B extend the central support block part 572 comprises threaded rod elements 5126A and 5126B and corresponding nuts 5127A and 5127B. Central support 572 can hereby be coupled to for instance travel rail ledgers which are described below.

Figure 5A:
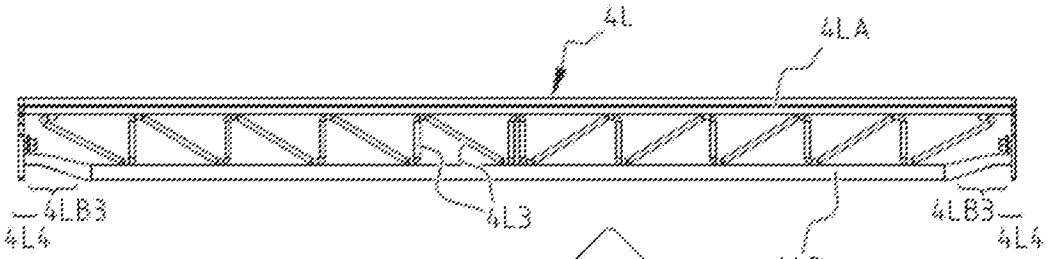
FIG. 5A shows a side view of a lengthwise ledger according to embodiments of the present invention.
Figure 5B:
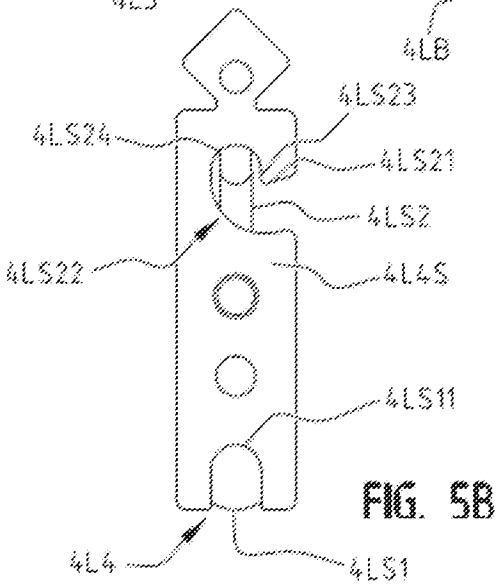
FIG. 5B is a front view of the coupling means of the ledger which comprises two slots.

Described in FIGS. 5A-5C is a ledger (e.g. travel rail ledger) for use in a scaffold according to preferred embodiments of the present invention. Ledger 4L comprises a coupling means 4L4 at each of its outer ends. The coupling means preferably comprises guide slots 4LS1 and 4LS2 adapted to be able, during placing of the ledger, to successively receive respectively a first threaded rod element and a second threaded rod element situated at fixed positions. These threaded rod elements are preferably arranged at an outer end of the support blocks 51, 52 or support ledgers 50 as described above in the longitudinal direction of the scaffold. The travel rail ledger preferably comprises a first rod 4LA which substantially defines the length of the ledger and which is coupled to coupling means 4L4 at its outer ends. In preferred embodiments this rod can serve as guide means for a displaceable platform (formed for instance by two parallel rods, two parallel ledgers). The rod can for instance comprise a square cross-section. The first rod 4LA of square cross-section can be oriented such that it lies with two diametrically opposite longitudinal ribs in a substantially vertical plane, as also described in respect of the support ledger 50. The two other diametrically opposite longitudinal ribs then lie in a substantially horizontal plane. The use of a guide surface formed hereby in combination with wheels on a displaceable platform which form a complementary guide surface provides for an increased stability of the displaceable platform on the formed rails. The complementary guide surfaces of the wheels of a displaceable platform can for instance comprise a substantially complementary radial recess (V-groove).

In preferred embodiments the travel rail ledger also comprises a second connecting element, such as a connecting rod 4LB, which is also connected at its outer end to coupling means 4L4 and which is also connected in between to the first connecting element, the first rod 4LA, by means of support structures 4L3. Use of this "double ledger structure" increases the load-bearing capacity of the ledger, which can be highly relevant particularly in the case a relatively great load has to be carried by the travel rail ledger. This is particularly the case when use is made of a mobile climbing lift or a mobile platform, which will typically have to carry and transport a substantial quantity of scaffolding, construction and other material as well as personnel.

In order to enable coupling to the threaded rod elements of the support blocks and/or support ledgers as described above, the travel rail ledger (more generally the lengthwise ledger) and the width ledger comprise a modified structure on their head. This structure comprises a substantially flat plate 4L4S which in determined embodiments can form part of a bracket structure substantially comprising two slots 4LS1 and 4LS2. Guide slots 4LS1 and 4LS2 are for instance provided in a coupling plate which is substantially flat and the main surface of which lies perpendicularly of the longitudinal direction of the ledger. The fixed position of the first and second threaded rods on the support blocks or support block ledgers is preferably such that they run parallel to the longitudinal direction of the ledgers when the guide slots receive the threaded rod elements and a coupling is thus formed between the ledger and the support block or support ledger. The slots can preferably comprise a lower slot 4LS1 and an upper slot 4LS2, wherein the upper slot lies at a higher position than the lower one. Lower slot 4LS1 is substantially straight and extends substantially vertically upward through a predetermined distance from the lower edge of the coupling plate. When a travel rail ledger or a width ledger is coupled to the threaded rod elements of the support blocks or support ledgers as described above, this can preferably take place by having the lower slot 4LS1 coupled to the lower threaded rod on the respective support blocks or support ledgers. Once the ledger, typically identical at both outer ends, is coupled to the respective first threaded rods, this ledger can temporarily support thereon. A coupling to the second slot 4LS2 can then be obtained in different ways depending on the type of slot for 4LS2.

According to a first embodiment for upper slots of the first type, upper slot 4LS2 extends from a lateral edge of the coupling plate and the upper slot comprises an entry opening at a height adapted to correspond to the predetermined position of the second bolt relative to the first bolt. The upper slot preferably extends further upward in a curve. The slot comprises a lower edge 4LS22 and an upper edge 2LS21 which come together at a highest point at the end of slot 4LS2. The positions of the outer ends of the lower and upper slot are preferably adapted such that they can simultaneously receive the respective first and second threaded rods close to their respective outer ends. The upper edge (or upper guide surface) of slot 4LS2 of the upper slot further comprises locally a downward directed dip 4LS23. This dip 4LS23 blocks the passage of the second threaded rod in second slot 4LS2 in the first instance after the second threaded rod has been received to limited extent by the second slot as a result of rotation of the ledger around the first bolt. The temporary blocking of the second threaded rod by this dip 4LS23 can be released by slightly lifting the ledger. This is preferably done through a distance smaller than the length of the lower slot, so that the coupling between the lower slot and the first threaded rod is not released. Slight lifting of the ledger in combination with a further rotation of the ledger around the first bolt then provides the final coupling between the two slots and the respective threaded rods. The positions of the threaded rods preferably correspond here with the outer ends of the slots 4LS1 and 4LS2. Surfaces 4LS11, 4LS24, which define the edge at the end of the respective slots 4LS1 and 4LS2, can particularly rest here on the respective threaded rods. The connection between the connecting elements (e.g. connecting rods) 4LA and 4LB and the coupling plates of coupling means 4L4 consequently takes place at locations differing from the locations of slots 4LS1, 4LS2 so as not to obstruct the coupling to the threaded rod elements by means of the slots. Upper rod 4LA can thus be fixed to the coupling plate above the second slot and lower rod 4LB can be fixed between the first slot and the second slot. The second rod can consequently be curved upward close to its outer ends, while away from its outer ends it is situated a constant distance from the first rod.

In preferred embodiments of the present invention a coupling means of the bracket type is used as coupling means for the width ledgers (also referred to as transverse ledgers or connecting ledgers) 4B. Such a structure allows tightening of respective nuts from inside the bracket in order to realize the coupling to respective support blocks or support ledgers. Such a ledger can comprise the same coupling structures with slots as described for the travel rail ledger or lengthwise ledger. FIG. 6A shows a perspective view, FIG. 6B shows a cross-section along the line C-C of FIG. 6C. FIG. 6C shows a side view of the connecting ledger. FIGS. 6D and 6E show side views of the coupling means and FIG. 6F shows a top view of the connecting ledger. The width ledgers can also be embodied without bracket structure, for instance with only a flat coupling plate as described for the lengthwise ledgers.

It can further be noted that the space created by the upper rods or connecting elements 4LA of square cross-section is not required for the width ledgers, since these are not typically used as guide means for a displaceable platform 3. Connecting elements 4BA can thus have a circular or other cross-section. Width ledgers 4B are further preferably embodied such that the upper surface of the upper connecting element 4BA lies below, preferably substantially below, the height of the upper side of connecting part 4LA so as not to obstruct the passage of a displaceable platform 3. The connecting ledger is preferably also of the double ledger type and consequently also comprises a connecting part 4BB which can for instance be embodied as a cylindrical rod. Connecting parts 4BA and 4BB are preferably connected to each other by means of support structures 4B3. This connecting ledger 4B is described in more detail in FIGS. 6A-6F.

Figure 7:
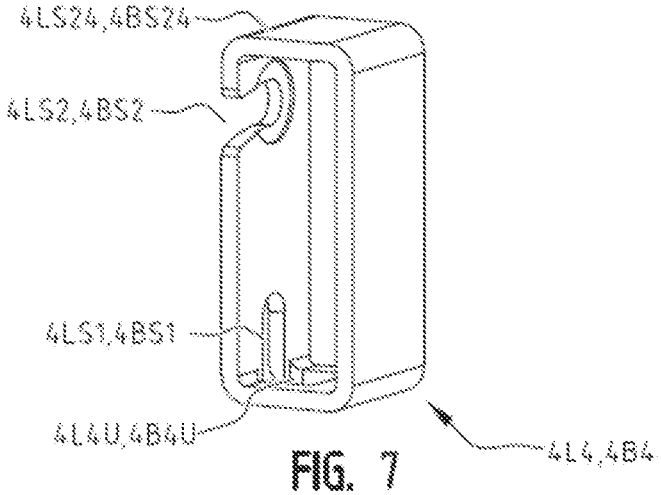
FIGS. 7 and 8A to 8C illustrate two types of pairs of slots in the coupling means of the ledgers according to embodiments of the present invention.

FIGS. 7A and 7B show in more detail the coupling means which will preferably be used for width ledgers 4B. Thus also shown in FIG. 7A is the recess or opening 4L4U, 4B4U arranged at the bottom of the bracket to allow the passage of nuts or bolt heads.

Figure 8A:
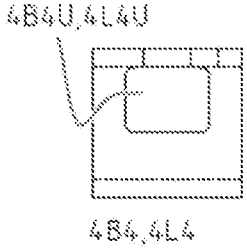
Figure 8B:
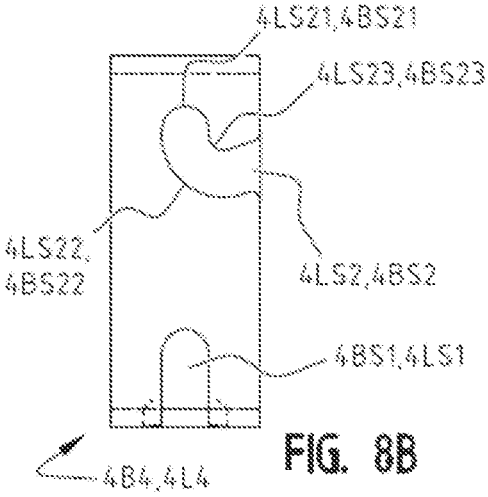
Figure 8C:
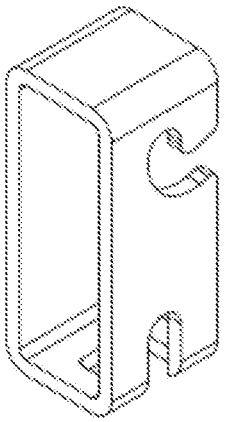

FIG. 8 shows an alternative coupling means which can be used for both lengthwise ledgers and width ledgers for the purpose of coupling to the threaded elements of the support blocks or support ledgers. The coupling mean shown here is of the bracket type and can preferably be used for width ledgers 4B. The coupling means can also comprise a single plate, this preferably for the lengthwise ledgers. There is then no recess 4L4U. Slots 4LS1, 4PS1, 4LS2 and 4PS2 can be identical to those described for FIG. 8. The coupling means comprises an upper slot 4LS2, 4BS2 which extends from a lateral edge of the coupling plate (bracket) and which comprises an entry opening lying at the height adapted to correspond to the predetermined position of the second threaded rod of the support block or the support block ledgers relative to the first threaded rod. In these embodiments of a second type for the second slots the upper slot further extends in an upward curving circular arc. The curvature of the circular arc corresponds to the rotation of the ledger round the first threaded rod. The coupling plate therefore preferably comprises on the rear side a recess 4LS24, 2BS24 which can receive, close to the outer end of the circular upper slot 4LS2, 4BS2, a nut which is coupled to the upper threaded rod when this nut is screwed on. Undesired release of the coupling resulting from a possible undesirable rotation of the ledger can in this way be prevented.

Figure 9A:
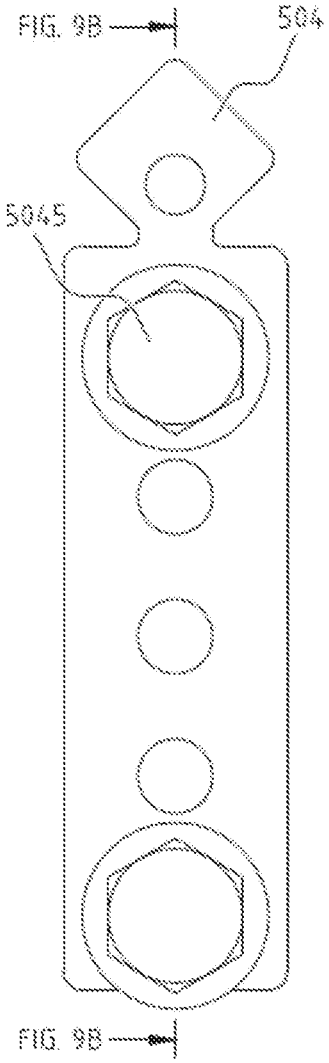
Figure 9B:
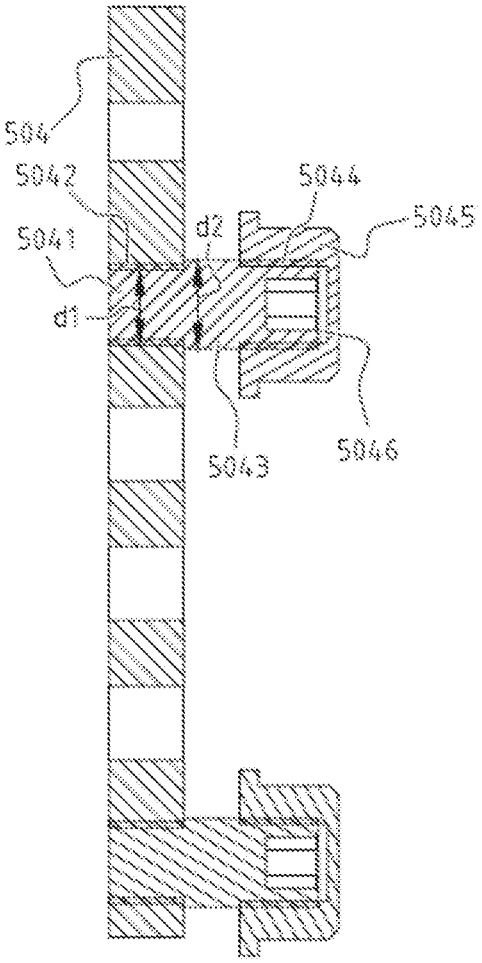

FIG. 9A shows a front view of a coupling plate such as can be comprised at the outer end of a support ledger 50, half support block 51 or extension ledger 4VL. In order to illustrate the idea a head 504 of a support ledger 50 is for instance considered (see also FIG. 3A). This also corresponds mutatis mutandis with the configuration of threaded rod elements on a narrow support block 52. FIG. 9B shows a cross-sectional view along the line A-A in FIG. 9A. The bolts or threaded rod elements 5043 are arranged in holes 5041 in plate 504. Holes 5041 comprise for this purpose screw thread 5042 into which the first longitudinal part of bolt 5042 with a first diameter d1 can be tightened. A second longitudinal part of the bolt has a broader diameter d2, wherein the transition from the part with diameter d1 to the part with diameter d2 is stepped. The part with diameter d2 hereby provides for a blocking effect from a determined screw-in depth of the bolt into opening 5041. The bolt does not comprise a classic "head" here but comprises an opening 5046, for instance a hexagonal opening, but also any other known form of opening, in which a screwing means such as a screwdriver or key can engage in order to realize screwing-in of the bolt. A nut 5045 can then co-act with a screw thread on the protruding part of the bolt.

The skilled person will appreciate that alternative systems of fastening the bolt are possible. The bolt can optionally also be arranged through an opening in a plate and secured by means of a nut or other element with screw thread along the rear side of the opening.

FIGS. 11A to 11E illustrate the extension ledger 4VL. Such a ledger can be used to later erect on for instance a narrow support block 52, or on the side without ledger part in a half support block 51, a scaffold section with a length substantially greater than the length of extension ledger 4L. For this purpose the extension ledger comprises at a first outer end a first coupling means 4VL41 and at a second outer end a second coupling means 4VL42. Two connecting parts 4VLA (upper) and 4VLB (lower) connect these two coupling means and are connected to each other by means of support 4VL3. The structure at the second outer end 4VL42 corresponds to the structure of coupling means 504 of the ledger as described for instance in FIGS. 5A and 5B, 8B. The structure at the first outer end corresponds for instance to the structure at the outer end of the ledger part of a support beam ledger as for instance described with reference to FIG. 3A or 4A.

Note that the coupling means of the longitudinal and width ledgers as described in the present invention can also be coupled to each other by means of bolts and nuts. This allows, if desired, mutual coupling of two or more longitudinal or width ledgers, and so the formation of longer ledger elements.

In the description of determined embodiments according to the present invention different features are sometimes grouped in a single embodiment, figure or description thereof, with the purpose of contributing toward the understanding of one or more of the different inventive steps. This may not be interpreted as if all features of the group are necessarily present in order to solve a specific problem. Inventive aspects are not to be found in all features of such group features present in the description of a specific embodiment.

While some of the embodiments described herein comprise some, but not other, features included in other embodiments, combinations or features of different embodiments are intended to lie within the scope of the invention and to form different embodiments, as would be appreciated by the skilled person.

While the principles of the invention have been described above in respect of specific embodiments, it must be clearly understood that this description is given only by way of example and is not limitative for the scope of protection defined by the appended claims.

The invention claimed is:

1. A scaffold comprising:

a plurality of lengthwise ledgers;

a plurality of transverse ledgers interconnecting the lengthwise ledgers; and a plurality of uprights supporting the plurality of lengthwise and transverse ledgers, wherein the scaffold has multiple scaffold sections having adjacent scaffold sections, each of the multiple scaffold sections comprising a plurality of pairs of horizontally parallel lengthwise ledgers of said plurality of lengthwise ledgers, wherein each lengthwise ledger of said plurality of lengthwise ledgers comprises a respective upper rod configured to allow a displaceable platform to be supported by at least one pair of the said plurality of pairs of horizontally parallel lengthwise ledgers of said plurality of lengthwise ledgers during a movement of said displaceable platform along the respective upper rods of the plurality of lengthwise ledgers, wherein the said plurality of lengthwise ledgers are coupled to the uprights via a plurality of intermediate support elements, wherein each of the plurality of pairs of horizontally parallel lengthwise ledgers are coupled to a respective inner side of each upright of said plurality of uprights via the plurality of intermediate support elements, wherein the lengthwise ledgers of adjacent scaffold sections of said multiple scaffold sections are interconnected via the intermediate support elements so that a plurality of pairs of horizontally parallel continuous rails are formed from the respective upper rods of each of the said plurality of lengthwise ledgers and are coupled to the respective inner side of the uprights throughout the adjacent scaffold sections of said multiple scaffold sections configured to allow the displaceable platform to roll along the rails without being obstructed by the uprights, and wherein each lengthwise ledger of said plurality of lengthwise ledgers comprises: a double ledger structure comprising the upper rod of each lengthwise ledger of said plurality of lengthwise ledgers coupled to a lower rod that is disposed in parallel directly beneath the upper rod of each lengthwise ledger of said plurality of lengthwise ledgers via a plurality of vertical support structures disposed there-between, and a plate disposed at each of a pair of outer ends of both the upper rod and lower rod of each lengthwise ledger of said plurality of lengthwise ledgers.

2. The scaffold according to claim 1, wherein the transverse ledgers are coupled to the lengthwise ledgers via the intermediate support elements which are disposed below the said plurality of pairs of lengthwise ledgers forming the said plurality of pairs of continuous rails, wherein the scaffold is configured to allow movement of the displaceable platform without obstruction by the transverse ledgers.

3. The scaffold according to claim 1, wherein the lengthwise ledgers are coupled to the intermediate support elements at respective sides facing a longitudinal direction, and wherein each of the intermediate support elements comprises an upper surface that is coupled to the plurality of pairs of continuous rails formed by the lengthwise ledgers throughout the adjacent scaffold sections of said multiple scaffold section.

4. The scaffold according to claim 3, wherein a length of the upper surface of the intermediate support elements is substantially greater than a width of the uprights.

* * * * *